US008516873B1

(12) United States Patent
Chan

(10) Patent No.: US 8,516,873 B1
(45) Date of Patent: Aug. 27, 2013

(54) PULLER FOR AUTOMOTIVE DENTS

(71) Applicant: Yi-Chang Chan, New Taipei (TW)

(72) Inventor: Yi-Chang Chan, New Taipei (TW)

( * ) Notice: Subject to any disclaimer, the term of this patent is extended or adjusted under 35 U.S.C. 154(b) by 0 days.

(21) Appl. No.: 13/691,784

(22) Filed: Dec. 1, 2012

(51) Int. Cl.
*B21D 1/12* (2006.01)
*B21J 9/18* (2006.01)

(52) U.S. Cl.
USPC ..... 72/447; 72/457; 72/705; 81/124.2

(58) Field of Classification Search
USPC ..... 72/447, 451, 457, 458, 705; 81/124.2
See application file for complete search history.

(56) References Cited

U.S. PATENT DOCUMENTS

| | | | | |
|---|---|---|---|---|
| 2,934,984 | A * | 5/1960 | Woodman | 72/457 |
| 3,030,837 | A * | 4/1962 | Chartier | 72/457 |
| 4,914,942 | A * | 4/1990 | Ishihara | 72/463 |
| 4,930,335 | A * | 6/1990 | Ishihara | 72/451 |
| 5,329,802 | A * | 7/1994 | Nunez | 72/457 |
| 5,943,902 | A * | 8/1999 | Ishihara | 72/451 |
| 6,722,179 | B1 * | 4/2004 | Ventura | 72/454 |
| 6,957,559 | B2 * | 10/2005 | Venalainen | 72/447 |
| 7,191,634 | B1 * | 3/2007 | Borgos, III | 72/409.01 |

* cited by examiner

*Primary Examiner* — David B Jones
(74) *Attorney, Agent, or Firm* — Pro-Techtor Int'l Services

(57) ABSTRACT

A puller for automotive dents includes a rod unit, a slide hammer, a first handle, a second handle, at least a pull piece and a pull assembly. A user puts a single pull piece or the pull assembly that is formed by plural pull blocks at an automotive dent and pulls flat an automotive dent by hammering with a DIY method to restore the automotive dent to a smooth surface.

4 Claims, 5 Drawing Sheets

PULLER FOR AUTOMOTIVE DENTS

BACKGROUND OF THE INVENTION a) Field of the Invention

The present invention relates to a puller for automotive dents, and more particularly to a repairing kit that can be used to completely repair auto body cavities by a DIY (Do It Yourself) method.

b) Description of the Prior Art

Dents are created on a general automobile when the automobile is hit by small rocks or foreign objects. An owner of the car cannot repair by a DIY method, and has to rely on an auto repair shop to repair the dents. Nevertheless, the majority of repair procedures taken by the auto repair shop include first hammering out the automotive dent cavity to restore it to a smooth surface, and then implementing a baking finish on the surface of the car body, which is both time consuming and very troublesome.

There are a few USA patents that mention a repairing kit for automotive dents, including U.S. Pat. Nos. 1,457,570, 1,696,462, 5,203,196 and 5,934,139. Nevertheless, all the abovementioned patents are different from the present invention.

SUMMARY OF THE INVENTION

The primary object of the present invention is to provide a puller for automotive dents that can be used to repair automotive dents by a DIY method.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
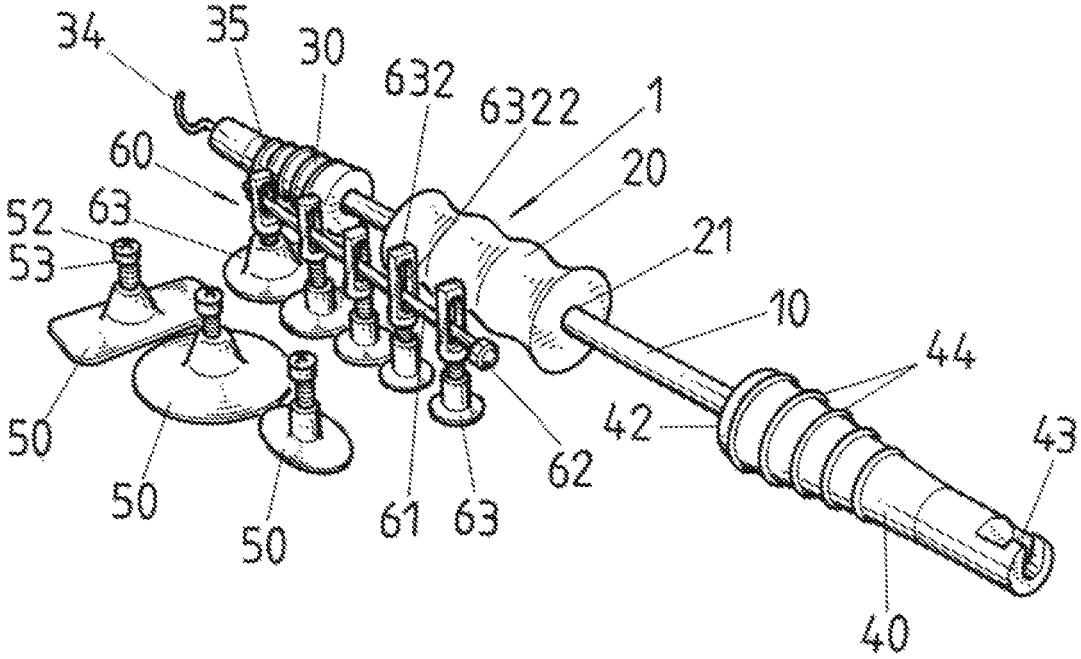
FIG. 1 shows a perspective view of the present invention.
Figure 2:
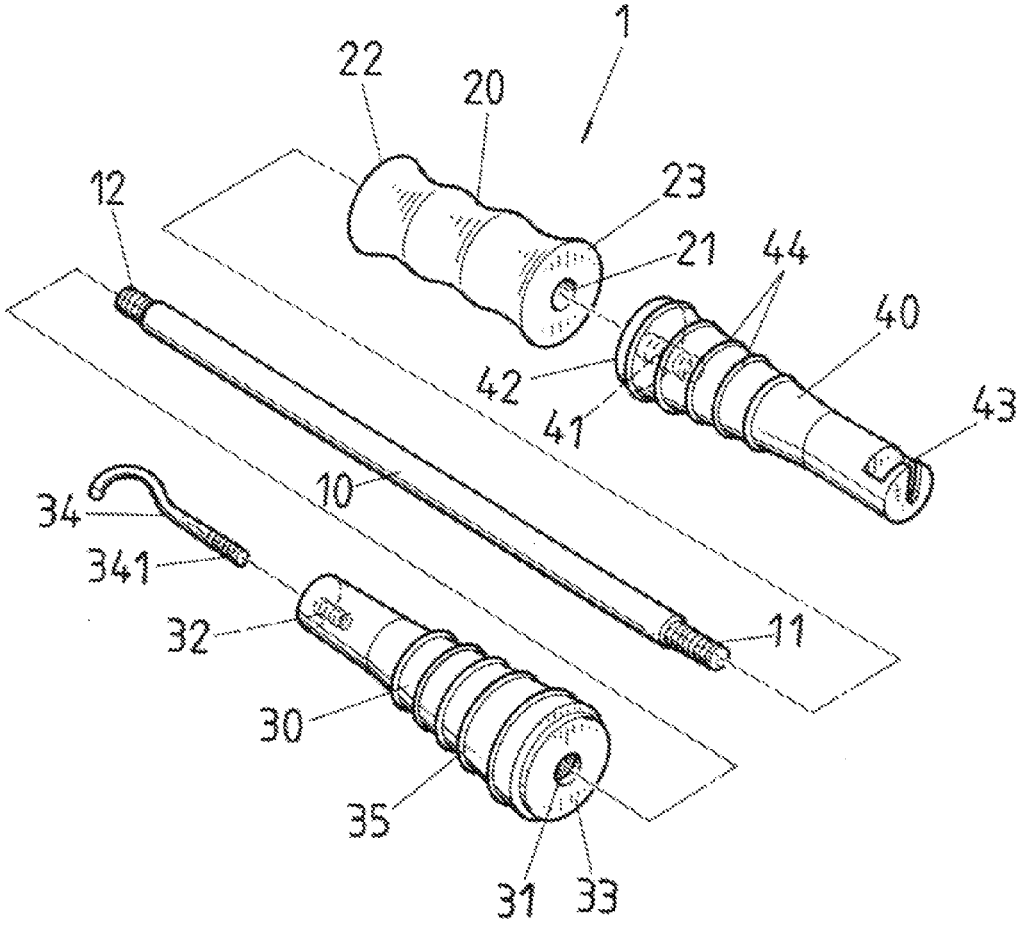
FIG. 2 shows a perspective view of components of the present invention.
Figure 3:
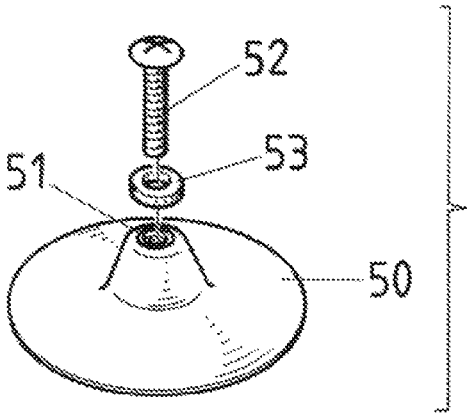
FIG. 3 shows a perspective view of components of a pull piece of the present invention.
Figure 4:
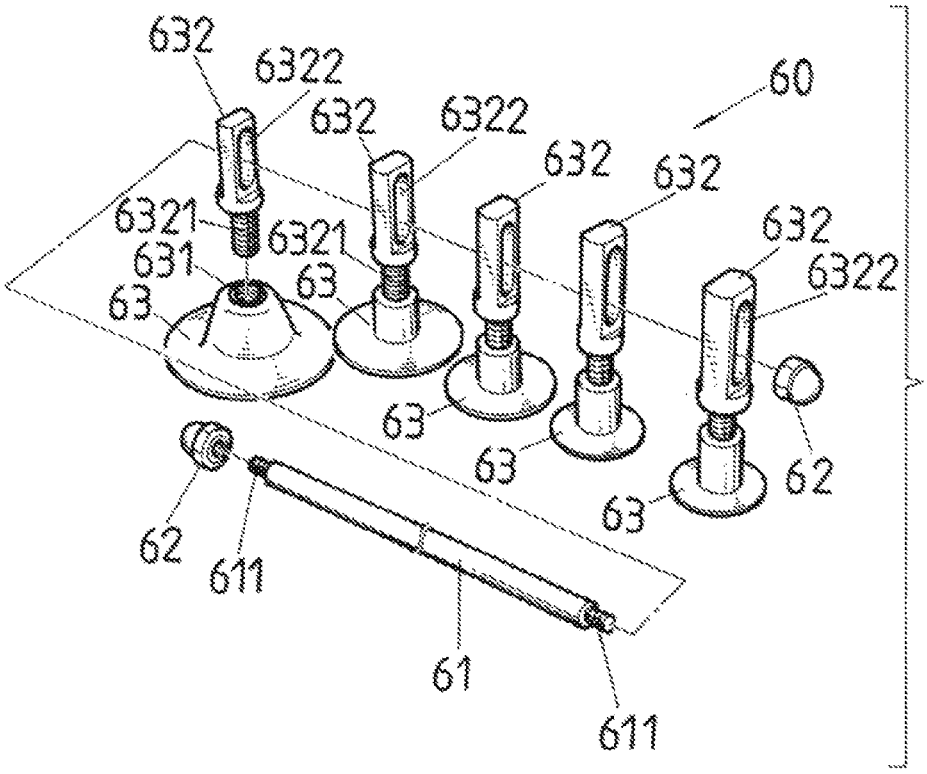
FIG. 4 shows a perspective view of components of a pull assembly of the present invention.

Referring to FIG. 1 and FIG. 2, it shows a puller for automotive dents of the present invention. The puller comprises:

a rod unit 10, two ends of the rod unit 10 being provided respectively with a screw 11, 12;

a slide hammer 20, a center of the slide hammer 20 being provided with a through-hole 21 that can be sheathed on the rod unit 10, with that two end surfaces of the slide hammer 20 are provided respectively with a hammering surface 22, 23;

a first handle 30, two ends of the first handle 30 being provided respectively with a threaded hole 31, 32, with that one threaded hole 31 provides for locking with the screw 12 of the rod unit 10, that end surface is a stop part 33 of a larger diameter, the other threaded hole 32 provides for locking with a screw 341 at one end of a hook 34, and a surface of the first handle 30 is concaved with plural collars 35 to facilitate holding by a user;

a second handle 40, a threaded hole 41 at one end of the second handle 40 providing for locking with the screw 11 at the other end of the rod unit 10, with that that end surface is a stop part 42 of a larger diameter, the other end is a T-shaped slot 43, and a surface of the second handle 40 is concaved with plural collars 44 to facilitate holding by the user;

at least a pull piece 50, the pull piece 50 being emplaced in the T-shaped slot 42 at one end of the second handle 40, with that the pull piece 50 can be a structure of all kinds of shapes and sizes, such as a circle, a square or an oval, to fit a size of the automotive dent, and a threaded hole 51 at one end of the pull piece 50 provides for locking with a bolt 52 after the bolt 52 has been sheathed with a washer 53, as shown in FIG. 3; and a pull assembly 60 (as shown in FIG. 4), the pull assembly 60 including a draw bar 61, two nuts 62 and plural pull blocks 63, with that two ends of the draw bar 61 are provided respectively with a screw 611, the pull blocks 63 can be a structure of all kinds of shapes and sizes, a threaded hole 631 at one end of the pull assembly 60 provides for locking with a screw 6321 at one end of a pole 632, the pole 632 is provided with a long bore 6322, the pull block 63 is sheathed on the draw bar 61 through the bore 6322, and the two nuts 62 are then locked on the screws 611 at two ends of the draw bar 61.

Figure 5:
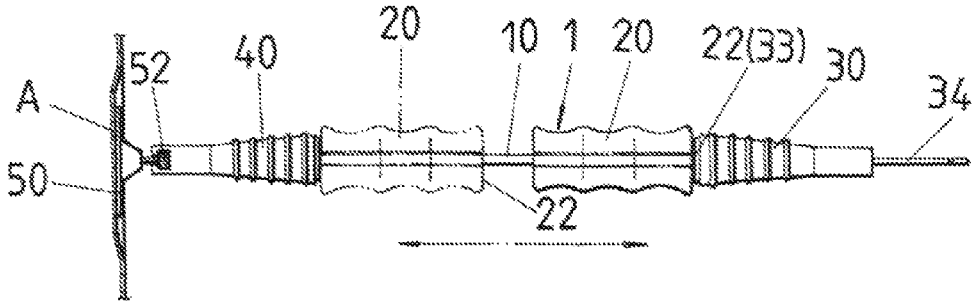
FIG. 5 shows a schematic view of a first embodiment of the present invention.
Figure 6:
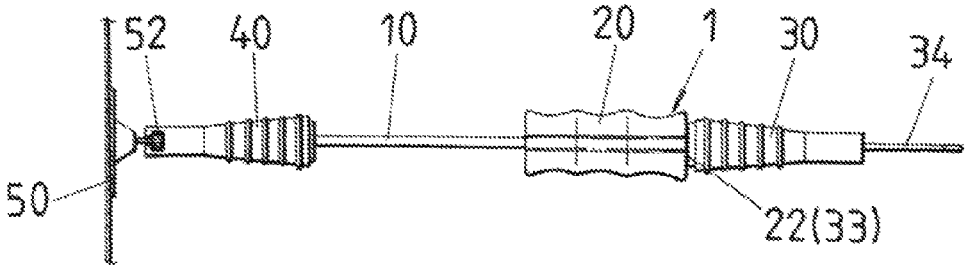
FIG. 6 shows a schematic view of pulling flat an automotive dent to restore the automotive dent to a smooth surface, as of FIG. 5.

Referring to FIG. 5, it shows a schematic view of a first embodiment of the present invention. The pull piece 50 at one end of the second handle 40 of the rod unit 10 is emplaced at an automotive dent A, the user holds the second handle 40 with one hand and operates the slide hammer 20 with the other hand to hammer the stop part 33 of the first handle 30 with the hammering surface 22, which pulls backward the rod unit 10 and drives the pull piece 50 to pull flat the automotive dent A, restoring the automotive dent A to a smooth surface (as shown in FIG. 6).

Figure 7:
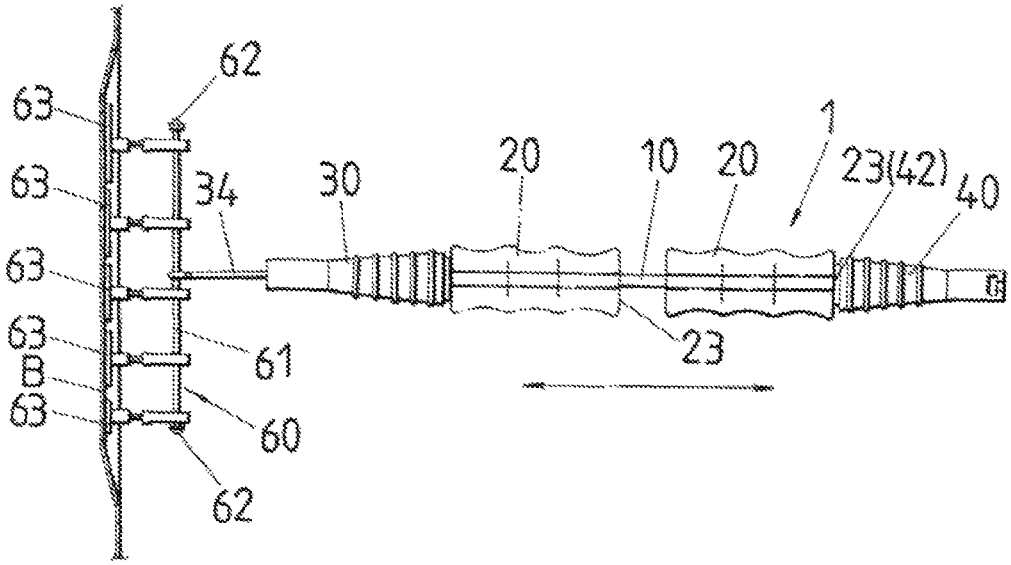
FIG. 7 shows a schematic view of a second embodiment of the present invention.
Figure 8:
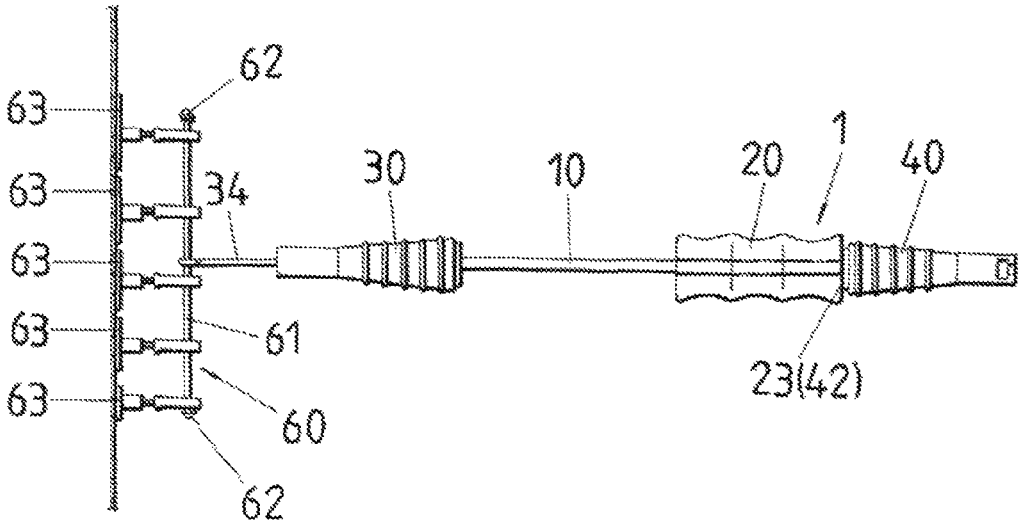
FIG. 8 shows a schematic view of pulling flat an automotive dent to restore the automotive dent to a smooth surface, as of FIG. 7.

Referring to FIG. 7, it shows a schematic view of a second embodiment of the present invention. When an automotive dent B is a straight line (or a long curve), the hook 34 at one end of the first handle 30 of the rod unit 10 is hooked at the draw bar 61 of the pull assembly 60 and the plural pull blocks 63 of the pull assembly 60 are emplaced at the automotive dent B. In addition, the user holds the first handle 30 with one hand and operates the slide hammer 20 with the other hand to hammer the stop part 42 of the second handle 40 with the hammering surface 23, which pulls backward the rod unit 10 to drive the plural pull blocks 63 simultaneously, thereby pulling flat the automotive dent B and restoring the automotive dent B to a smooth surface (as shown in FIG. 8).

In conclusion, the present invention provides a puller for automotive dents. The puller is a dual-purpose tool, allowing the user to repair automotive dents by him or her alone with the DIY method. Moreover, as the abovementioned components can be easily dismantled, the puller can be carried and packaged conveniently, which improves the value of business application.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A puller for automotive dents, comprising:

a rod unit, is said rod unit having two ends each end provided respectively with a thread;

a slide hammer, a center of the slide hammer is provided with a through-hole, said rod unit passing through said through-hole and said slide hammer comprises two hammering surfaces;

a hook, comprising a threaded end;

a first handle comprising a first and second end, said first end being of greater diameter than said second end and said first and second ends of the first handle are provided respectively with a threaded hole, with that the first threaded hole interlocks with one thread of the rod unit, and the second threaded hole interlocks with the thread at of said hook;

a second handle comprising a first and second end, said first end being of greater diameter than said second end and said first and second ends of the first handle are provided respectively with a threaded hole, with that the first threaded hole interlocks with one thread of the rod unit, and the second end comprises a T-shaped slot;

at least a pull piece, the pull piece fits in the T-shaped slot at one end of the second handle;

a plurality of poles, said poles comprising a bore and a first and second end, and said first end comprising a threaded end; and a pull assembly, the pull assembly includes a draw bar, said draw bar comprising two ends, said two ends of the draw bar are provided respectively with a thread, two nuts, said two nuts thread on the threads at end two ends of the draw bar, wherein the draw bar passes through the bores of each of the poles, and plural pull blocks, said pull blocks each having an end with a threaded hole such that the threaded hole of a pull blocks interlock with the threaded end of a pole, and the hook of the first handle hooks to the draw bar.

2. The puller for automotive dents according to claim 1, wherein a surface of the first handle is concaved with plural collars.

3. The puller for automotive dents according to claim 1, wherein a surface of the second handle is concaved with plural collars.

4. The puller for automotive dents according to claim 1, further comprising a bolt and a washer, wherein the threaded hole at one end of the pull piece interlocks with the bolt, and wherein the bolt passes through the washer.

* * * * *